US007098867B1

(12) United States Patent
Gullapalli

(10) Patent No.: US 7,098,867 B1
(45) Date of Patent: Aug. 29, 2006

(54) SYSTEM AND METHOD FOR PACKAGING AND DEPLOYING A SEGMENTED REFLECTOR ANTENNA

(75) Inventor: Sarma N. Gullapalli, Centerville, VA (US)

(73) Assignee: General Dynamics Advanced Information Systems, Inc., Arlington, VA (US)

( * ) Notice: Subject to any disclaimer, the term of this patent is extended or adjusted under 35 U.S.C. 154(b) by 114 days.

(21) Appl. No.: 10/866,820

(22) Filed: Jun. 15, 2004

Related U.S. Application Data

(60) Provisional application No. 60/485,111, filed on Jul. 8, 2003.

(51) Int. Cl.
*H01Q 15/14* (2006.01)

(52) U.S. Cl. ..... 343/915; 343/840; 343/881

(58) Field of Classification Search ..... 343/840, 343/881, 912, 915; 342/8, 10
See application file for complete search history.

(56) References Cited

U.S. PATENT DOCUMENTS 3,715,760 A * 2/1973 Palmer ..... 343/915
6,195,056 B1 * 2/2001 Jones ..... 343/704
6,323,827 B1 * 11/2001 Gilger et al. ..... 343/915
6,873,460 B1 * 3/2005 Burstyn et al. ..... 359/461
2005/0183377 A1 * 8/2005 Johnson ..... 52/646

* cited by examiner

*Primary Examiner*—Tan Ho
(74) *Attorney, Agent, or Firm*—Michael J. Bell; Howrey LLP

(57) ABSTRACT

An embodiment of the invention generally relates to an apparatus for deploying a segmented reflector antenna. The apparatus includes a plurality of segments that can be rigid or flexible where each segment is hinged to an adjacent segment on either longitudinal side. The apparatus also includes a base, a plurality of inner deployment beams, and a plurality of outer deployment beams. Each inner deployment beam connects an inner side of a respective segment to the base and having a folded position and an extended position. Each outer deployment beam connects an outside side of a respective segment to the base and has a folded position and an extended position. The plurality of segments in a hinged folded position in response to the plurality of inner deployment beams being in the folded position and the outer deployment beams being in the folded position.

29 Claims, 6 Drawing Sheets

200

200'

SYSTEM AND METHOD FOR PACKAGING AND DEPLOYING A SEGMENTED REFLECTOR ANTENNA

CROSS-REFERENCE TO RELATED APPLICATIONS

This application claims the benefit of U.S. Provisional Application No. 60/485,111, filed on Jul. 8, 2003, the contents of which are hereby incorporated by reference in its entirety.

BACKGROUND OF THE RELATED ART

Structures, e.g., conventional collapsible dish structures with flexible mesh or flexible surfaces, that can be folded during transit and deployed upon reaching their destination have been widely used, particularly in situations in which cargo space is limited or otherwise at a premium. Advantageously, collapsible structures may be stowed compactly in a vehicle while not in use, and then deployed to a desired configuration to perform a given application. Although the space-saving characteristics of collapsible structures benefit many applications, space applications in particular stand to benefit to a high degree due to the limited amount of cargo space onboard a spacecraft and the high cost of space travel.

Recent spacecraft applications have mandated the use of shorter wavelengths in the electromagnetic spectrum, as well as an increased interest in the collection and focusing of light waves in space, collapsible dish structures have been required to meet stringent requirements for surface smoothness and contour control to minimize scattering and improve antenna gain. These requirements have resulted in an increased dependence on the type of antenna, which utilize solid panels. These solid panel type antennas are more suitable for short and optical wavelengths as compared with mesh collapsible antenna designs.

Several approaches currently are used to address the transportation of deployable rigid antenna systems on a spacecraft. One conventional method of packaging includes hinging segments only on the inside edges of the segments. The segments are then stowed, alternately forward and aft, and then opened out to the final positions. Another example of a conventional method includes stacking the segments horizontally, either individually or in pairs, where the segments or the pairs are not fully connected at the edges. During deployment, the segments are swung into their respective final positions. Yet another conventional method of packaging involves stacking the segments vertically, either individually or in pairs, where the segments or the pairs are not fully connected together at the edges. During deployment, the segments are moved into their final positions.

These conventional methods of packaging segmented rigid reflectors suffer from complexity in the implementation of the packaging and result in inefficient use of the stowed volume, and problematic gaps between the deployed segments or between pairs of segments.

SUMMARY OF THE INVENTION

An embodiment of the invention generally relates to an apparatus for deploying an antenna. The apparatus includes a plurality of segments where each segment is hinged to an adjacent segment on a longitudinal side. The apparatus also includes a base, a plurality of inner deployment beams, and a plurality of outer deployment beams. Each inner deployment beam connects an inner side of a respective segment to the base and has a folded position and an extended position. Each outer deployment beam connects an outer side of a respective segment to the base and has a folded position and an extended position. In the stowed position, the plurality of segments is in a hinged folded position in response to the plurality of inner and outer deployment beams being in the folded position.

Another embodiment of the invention generally pertains to a method for deploying an antenna. The method includes extending a plurality of inner and outer deployment beams from a folded position. The inner and outer deployment beams are attached to a base of the antenna and to an inner and outer edge, respectively, of a plurality of segments. Each segment is hinged to an adjacent segment on a longitudinal side. The method also includes forming a deployed position for the antenna in response to the inner and outer deployment beams reaching a deployed position and the plurality of segments being in an extended state.

Yet another embodiment of the invention generally relates to an apparatus for deploying an antenna. The apparatus includes a plurality of segments, where a segment hinged to an adjacent mirror segment on either longitudinal side. The apparatus also includes a base, a plurality of inner deployment beams and outer deployment beams. Each inner deployment beam is connected to an inner side of a respective segment to the base and having a folded position and an extended position. Each outer deployment beam is connected to an outside side of a respective mirror segment and to the base having a folded position and an extended position. The plurality of segments is in a substantially aligned position forming the reflector dish in response to the plurality of inner and outer deployment beams being in their respective extended positions.

BRIEF DESCRIPTION OF THE DRAWINGS

While the specification concludes with claims particularly pointing out and distinctly claiming the present invention, it may be believed the same will be better understood from the following description taken in conjunction with the accompanying drawings, which illustrate, in a non-limiting fashion, the best mode presently contemplated for carrying out the present invention, and in which like reference numerals designate like parts throughout the figures, wherein:

DETAILED DESCRIPTION OF THE EMBODIMENTS

Figure 1A:
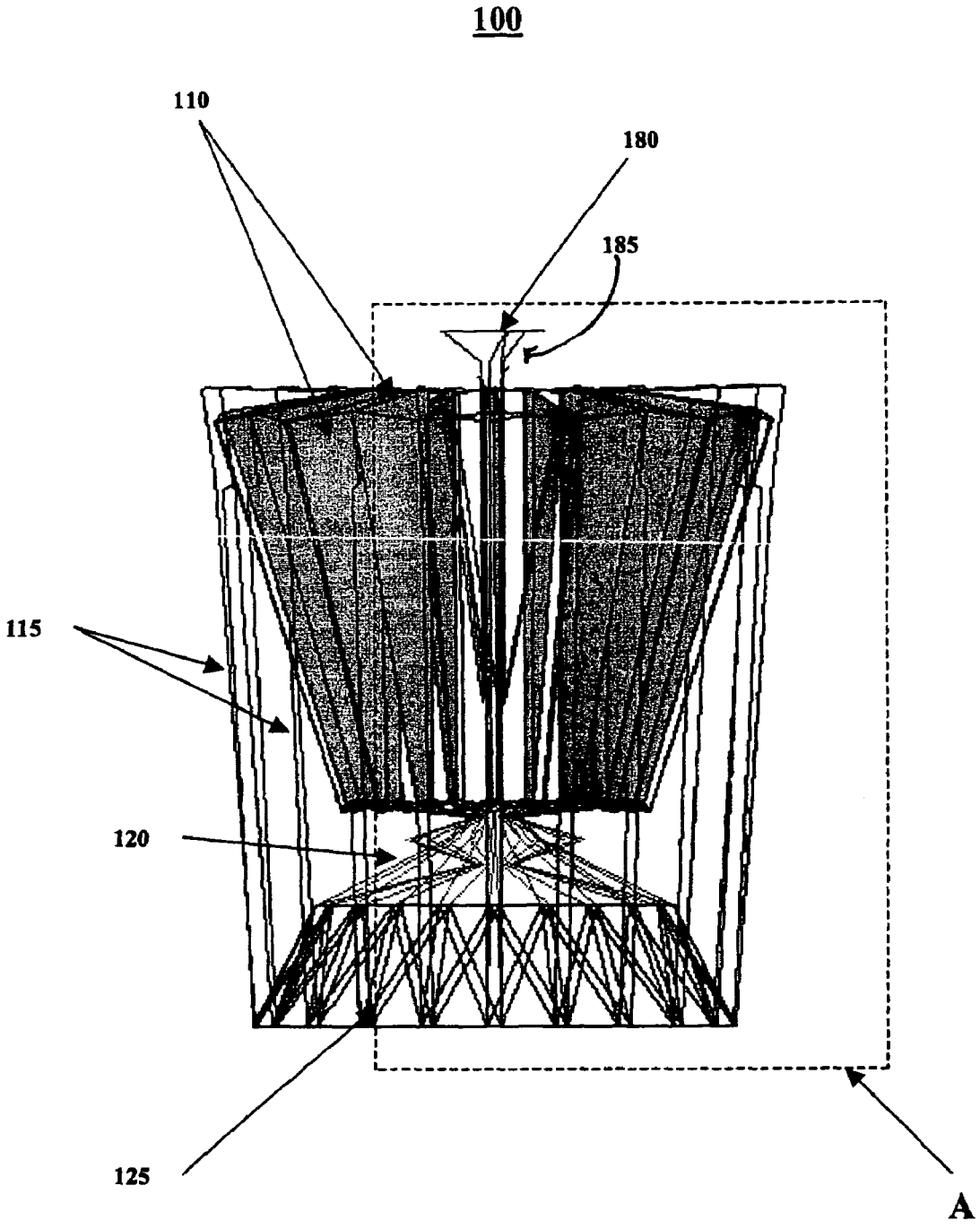
FIG. 1A illustrates a stowed view of an embodiment of the invention.

For simplicity and illustrative purposes, the principles of the present invention are described by referring mainly to exemplary embodiments thereof. However, one of ordinary skill in the art would readily recognize that the same principles are equally applicable to, and can be implemented in, many types of systems that use an antenna, reflector or other similar device, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

An embodiment of the invention generally relates to a structure or apparatus for the deployment of an antenna, reflector or other similar device. In embodiments of the invention, the antenna may comprise a plurality of substantial identical segments or panels. The number of segments depends on performance requirements and/or stowage volume constraints, of the antenna. A selected segment is connected through hinge mechanisms to adjacent segments on the longitudinal sides of the selected segment. In one embodiment, on one longitudinal side of a selected segment, the hinge mechanism is located on one of the back or front side of the selected segment. On the second longitudinal side of the same segment, a second hinge mechanism is located on the other of the back or front side of the selected segment. In effect, with the alternating position of the hinges on the longitudinal sides of the segments, the segments may have an accordion-like configuration when viewing the stowed segments of the satellite in a plan and/or bottom perspective.

The segments of the antenna may be implemented using, but not limited to, glass, silicon carbide, nanolaminates, copper, aluminum, beryllium, composites, plastics, membranes, any of which may have various coatings and the like. Moreover the segments of the antenna may include a variety of designs such as solid, foam, ribbed, deformable, non-deformable, actuated, non-actuated, thermally controlled, open back, closed back, bipod mounted, rigid mounted, and other various configurations and mounting methods within each individual segment's frame.

In some embodiments, the segments of the antenna may include embedded actuators to change the shape of the segment in applications where the ability to change segment shape may be desirable. In other embodiments, the front surface of the segments of the antenna may be implemented in any general shape that may be part of a sphere, paraboloid, ellipsoid, hyperboloid, or any aspheric reflector, when deployed.

In embodiments of the invention, the antenna also includes a base. The base may be configured to house equipment for the antenna such as a waveguide, focal plane, sensors, sources or similar electronic devices. In other embodiments, the base may include a base ring configured to provide an attachment surface for deployment beams.

The antenna further comprises multiple inner and outer deployment beams. Each outer deployment beam may be attached substantially near a hinge area on the outside (or top, "top" in the stowed position) of the segments between adjacent segments as well as to the bottom of the base. Each inner deployment beam may be attached to the top side of the base (or base ring) of the antenna as well as substantially near a hinge point on the inside (or bottom, "bottom" in the stowed position) of the segments. Each outer and inner deployment beam may have an extended position and a folded position.

The deployment beams may be implemented using, but not limited to, aluminum, invar, graphite epoxy, plastic, composites, silicon carbide, shape memory materials, rigidizable materials and other similar materials. The deployments beams may have a design of a tube, box, truss, I-beam, isogrid, inflatable rigidizable, shape memory design or other similar design. The deployment beams may also include deployment means, e.g., motors that may be actuated or non-actuated.

Accordingly, the antenna may be in a stowed position when the inner and outer deployment beams are in their respective folded positions. When the deployments beams are folded, the segments are in a folded position and substantially vertical around the base of the antenna, i.e., the segments are perpendicular to the base. The antenna may move to deployed position in response to the inner and outer deployment beams moving to their respective extended positions where the segments unfold to become substantially aligned forming the required reflecting dish surface. In one embodiment, a motor or motor/encoder may be used to drive each inner and outer deployment beam, and each hinge between segments. In other embodiments, a single motor or motor/encoder may drive a number of deployment beams and hinges between the segments, using a suitable scheme such as a cable strung through the hinges. In yet other embodiments, a few motors or motor/encoders at selected segments (but not all) may drive the deployment beams or hinges between segments.

In some embodiments, the outer and inner deployment beams may be constructed from rigid materials. In other embodiments, a subset of deployment beams or sections of the deployments beams may be constructed from other material types such as the inflatable rigidizable type. It should also be readily apparent to those skilled in the art that other types of actuators such as stepper motors or motors made of or aided by smart materials may also be used to deploy the segments. At the end of deployment, latches may be engaged to improve the alignment between adjacent segments.

FIG. 1A illustrates a stowed position for an antenna 100 in accordance with an embodiment. For illustrative purposes only, "reflective side" refers to the side of the segment that forms the reflective surface of the antenna; the "non-reflective side" refers to the non-reflective side of the segment; the "outside" refers to the side of the segment that forms the outer arc of the antenna or the "top" of the antenna when the antenna is in the stowed position; and the "inside" refers to the side of the segment that forms the inner arc of the antenna or the "bottom" when the antenna is in the stowed position.

As shown in FIG. 1A, the antenna 100 comprises a plurality of segments 110, a plurality of outer deployment beams 115, a plurality of inner deployment beams 120, and a base 125, secondary reflector (or feed horn) 180 and a plurality of reflector (or feed horn) deployment beams 185.

Although not shown, additional hardware may be included to lock the components in place when stowed and not in use or during launch.

In the illustrated stowed position, the segments 110 are in an annular formation, where the hinged segments are in an accordion-like configuration, where the folded segments 110 are in a substantially vertical orientation. To achieve this circular accordion-like configuration, hinges are attached to the longitudinal sides of the segments 110 to form a hinged joint in an alternating position, as explained above and in greater detail below and shown in FIGS. 1C–D. More particularly, on one hinged joint, the respective pivots of the hinges may face one direction and, on the adjacent hinged joints, the respective pivots of the hinges face may towards the opposite direction. In other words, every other hinged joint between the segments have respective pivots of the hinges facing the same direction. Although in this embodiment, it is contemplated that two hinges are used between adjacent segments, other embodiments may use a decreasing or an increasing number of hinges depending the requirements of the antenna.

Figure 1B:
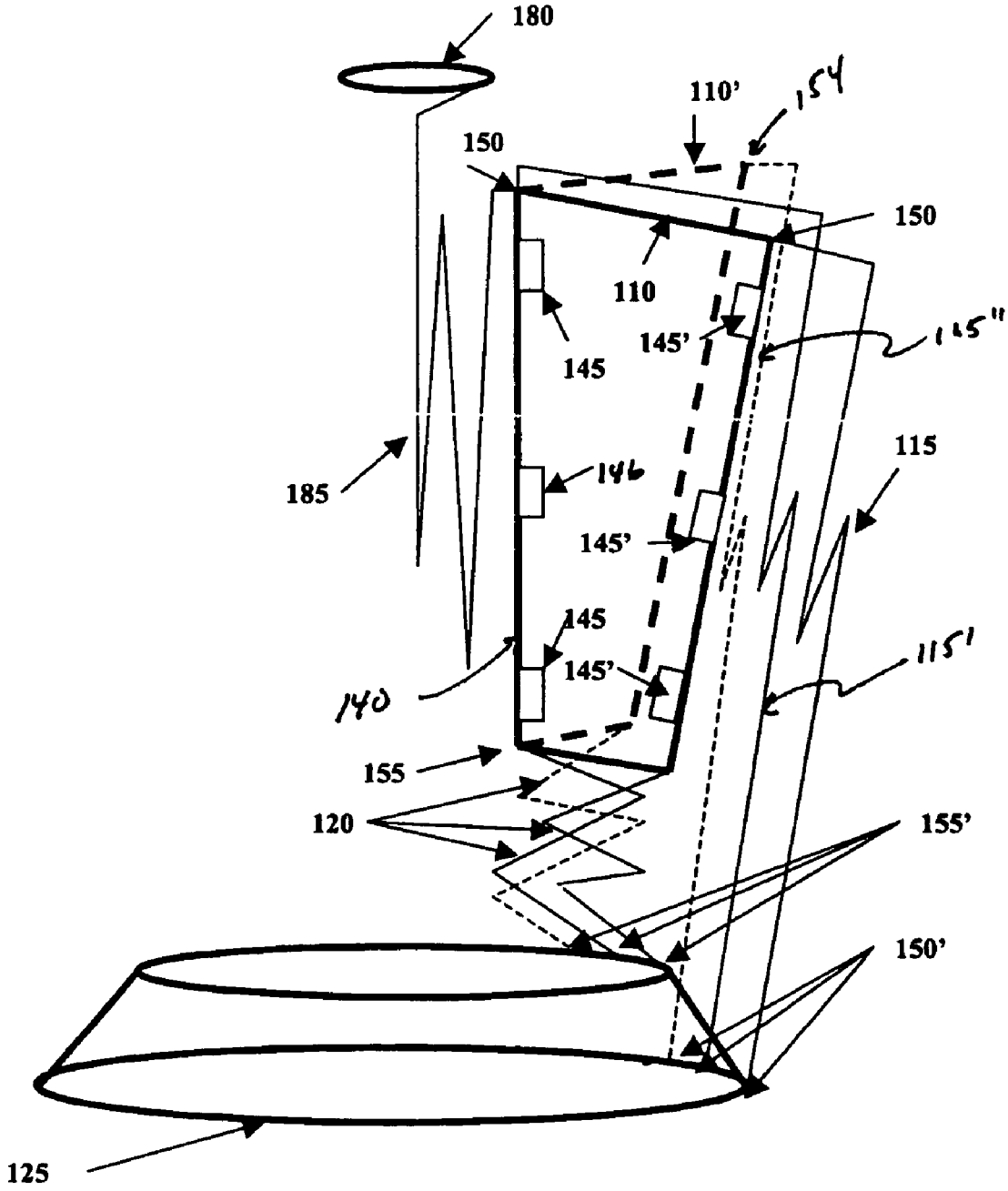
FIG. 1B illustrates a detailed view of section A shown in FIG. 1A.

FIG. 1B illustrates in greater detail of section A of FIG. 1A. As shown in FIG. 1B, two segments 110 and 110' are fully hinged, i.e., more than one hinge means, together in a folded position on a longitudinal side 140 by hinge means 145. A longitudinal side 140' of segment 110 is fully hinged to an adjacent segment (not shown) by hinge means 145'. Although shown with two hinge means on each longitudinal side, the number of hinge means may increase or decrease depending on the dimensions of the segments 110 for a particular antenna. Since the front (reflecting) side of a segment is typically curved in most applications, hinges are preferably attached at the corners of the segment when locating hinges to the front side of segment. In contrast, when hinges are attached to the opposite (back side, non-reflecting) side, these hinges may be located at any location along the back edge, which can be flat.

For certain embodiments, hinges may be located on the front side of the segment, i.e., reflecting side. Hinges attached to the front of the segment may scatter incident electromagnetic radiation. If the scattering is tolerable within the particular application of the antenna, these hinges may be attached at any point above the curved front surface of a segment in between the corners of the segment.

Latches 146, either as part of the hinge assembly or as separate components, may be included to improve the alignment between segments. In some embodiments, latches may be desirable in more demanding applications. If latches are included, the latches may be driven by the actuators in the hinges, or by separate actuators, or may not be actuated at all. Hinge/latch designs may be custom designed for the particular application.

In accordance with embodiments of the invention, hinge means are attached to the sides of a segment in alternating positions to enable the accordion-like configuration. For example, hinge means 145 may have its pivot facing the reflecting side of the segment 110 while hinge means 145' may have its pivot facing the opposite direction, i.e., non-reflective side. In other embodiments, hinge means 145 may be attached to the non-reflective side of the segment 110 while hinge means 145' may be attached to the reflective side of the segment 110. The outer deployment beams 115 are attached to a respective outer corner of the segment 110. More particularly, a first end 150 of an outer deployment beam 115 is substantially attached to the outer corner of segment 110. The attachment means of the first end of the outer deployment beam 115 to the top of the segment may be a hinge, an eyelet or other similar fastening means. The second end 150' of the outer deployment beam is attached to the base 125. The attachment means for the second end of the outer deployment beam to the base may also be hinge, an eyelet, or other similar fastening means.

Similarly, outer deployment beam 115' is attached to the other outside corner 152 of segment 110 and attached to the base at 150'. Alternatively, the outer deployment beam 115' may be attached to the adjacent outer corner of segment 110'. Similarly, outer deployment beam 115" is attached to the second outside corner 154 of segment 110 and attached to the base at 150'.

The outer deployment beams 115, in the stowed position, are in a folded position. Although shown generally as an "L" shape in FIG. 1B, in the other embodiments, the outer deployments beams 115 may be in any folded position as required by the geometry of the antenna, the storage requirements, etc. The outer deployment beams can be folded or telescoped or involve a combination of folding and telescoping, depending on the initial length (in stowed position), the final length (in deployed position) and the length at intermediate positions during deployment.

The inner deployment beams 120 are attached to the inner side or bottom of the segments 110. More particularly, a first end 155 of an inner deployment beam 120 is substantially attached to one of the inner corners of the two segments 110 and 110'. The attachment means of the first end of the inner deployment beam 120 to one of the inner corners the segment 110, 110' may be a hinge, an eyelet or other similar fastening means (not shown). The second end 155' of the inner deployment beam 120 is attached to the base 125. The attachment means for the second end 155' of the inner deployment beam 120 to the base may also be a hinge, an eyelet, or other similar fastening means (not shown).

The inner deployment beams 120, in the stowed position, are in a folded position. Although shown as a substantially "S" shape in FIG. 1A, in the other embodiments, the inner deployments beams 120 may be in any folded position as required by the geometry of the antenna, the storage requirements, etc. The inner deployment beams can be folded or telescoped or involve a combination of folding and telescoping, depending on the initial length (in stowed position), the final length (in deployed position) and the length at intermediate positions during deployment.

Figure 1C:
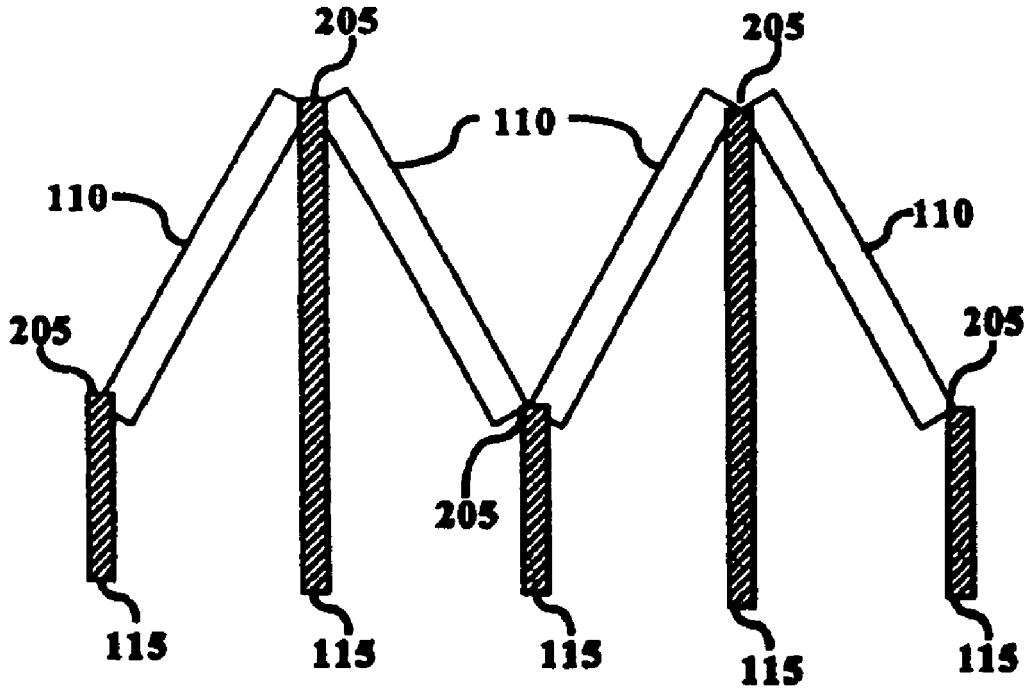
FIG. 1C illustrates a plan (top) view of the embodiment shown in FIG. 1A in accordance with an embodiment of the invention.

FIG. 1C illustrates a plan view of the embodiment shown in FIG. 1A. As shown in FIG. 1C, segments 110 are in a folded position. The outer deployment beams 115 are attached to one of the outer corners 205 of the two segments. Although the outer deployment beams 115 are shown attached to one of the outer corners 205 between two segments, other embodiments of the invention may have the outer deployment beams attached in other configurations. For example, the outer deployment beams 115 may be attached to every other paired hinged segments. It should be readily apparent to those skilled in the art that other attachment configuration of the outer deployment beams 115 may be implemented are well within the spirit and scope of the present invention as long as those attachment configuration provides unfolding of the segments 110.

Figure 1D:
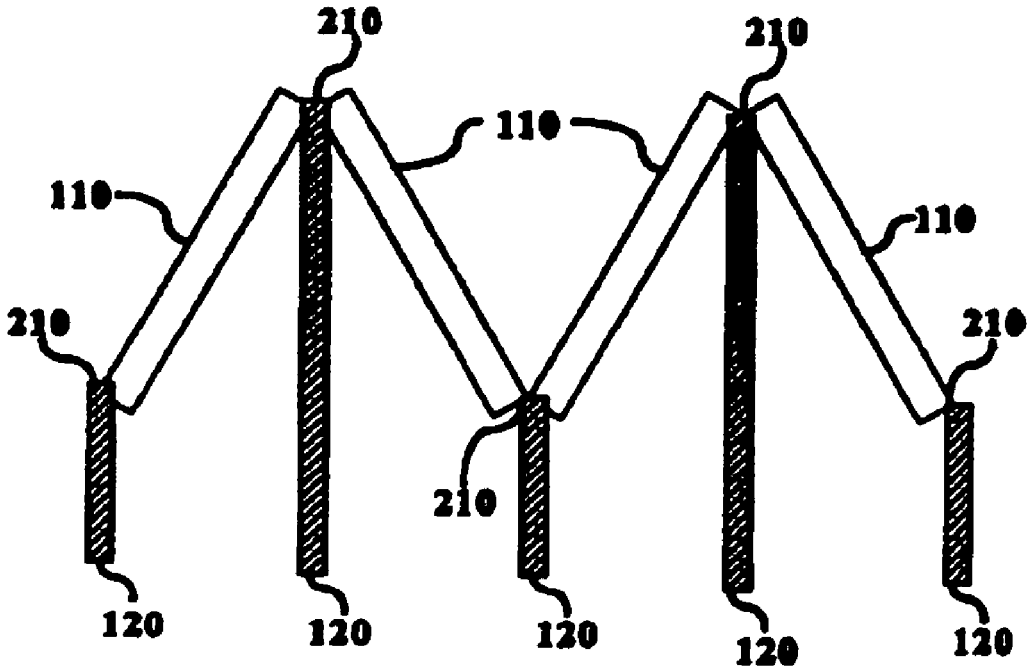
FIG. 1D illustrates a bottom view of section A shown in FIG. 1A in accordance with yet another embodiment of the invention.

FIG. 1D illustrates a bottom view of sectional A as shown in FIG. 1A. As shown in FIG. 1D, segments 110 are in a folded position. The inner deployment beams 120 are attached to one of the inner corners 210 of the two segments. Although the inner deployment beams 120 are shown attached to one of the inner corners 210 of the two segments 110, other embodiments of the invention may have the inner deployment beams attached in other configurations. For example, the inner deployment beams 120 may be attached to every other pair of hinged segments. It should be readily apparent to those skilled in the art that other attachment configurations of the inner deployment beams 120 may be implemented within the spirit and scope of the present invention as long as those attachment configurations enable folding and unfolding of the segments 110.

Figure 1E:
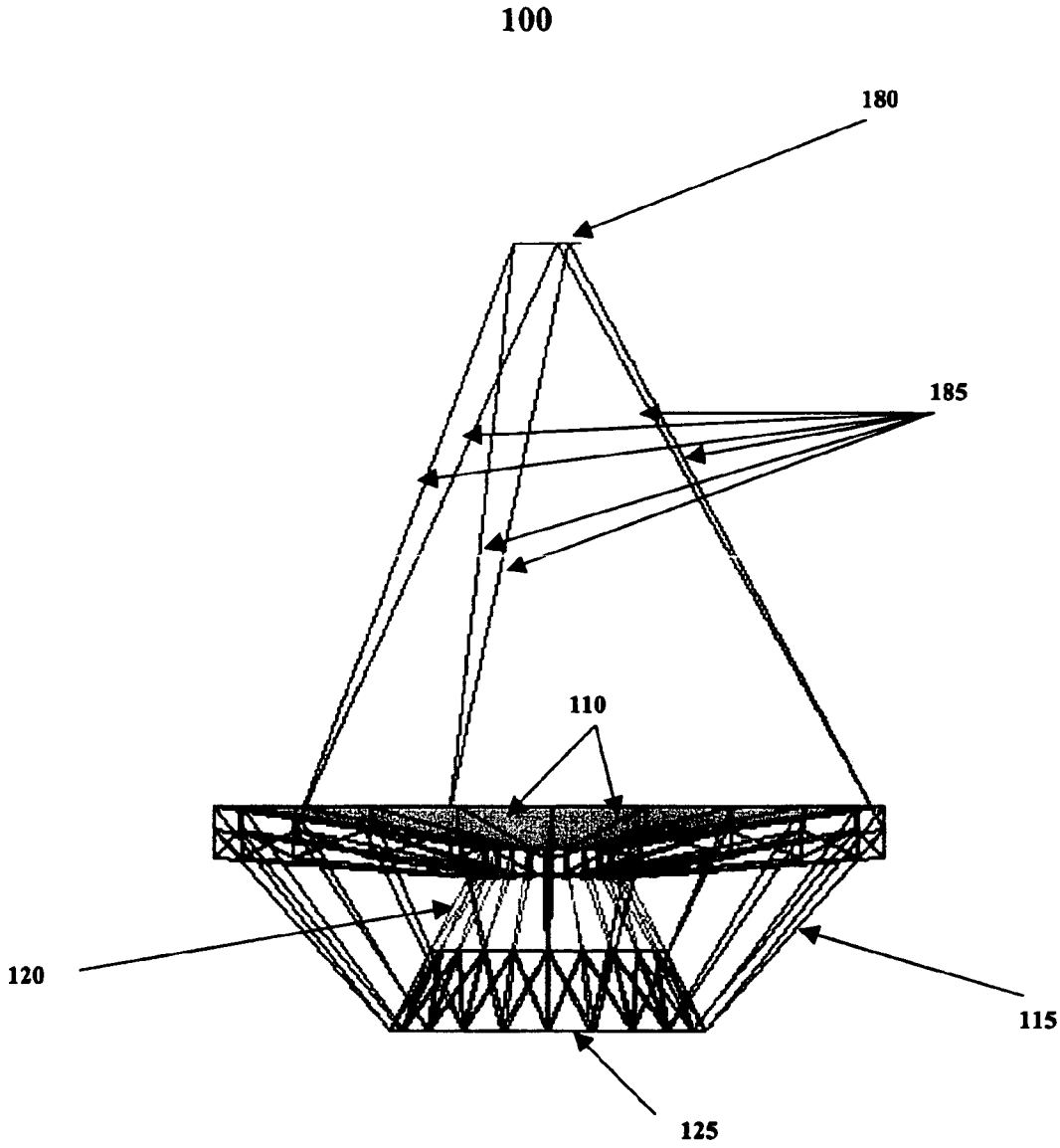
FIG. 1E illustrates a deployed view of yet another embodiment of the invention.

With reference to FIG. 1E, the antenna 100 has reached the deployed position. As shown in FIG. 1C and FIG. 1D, the inner and outer deployment beams, 120 and 115, respectively, are in their respective extended position in FIG. 1E. The segments 110 have unfolded into a substantially co-aligned position and are ready to receive signals in the electromagnetic spectrum.

Figure 2A:
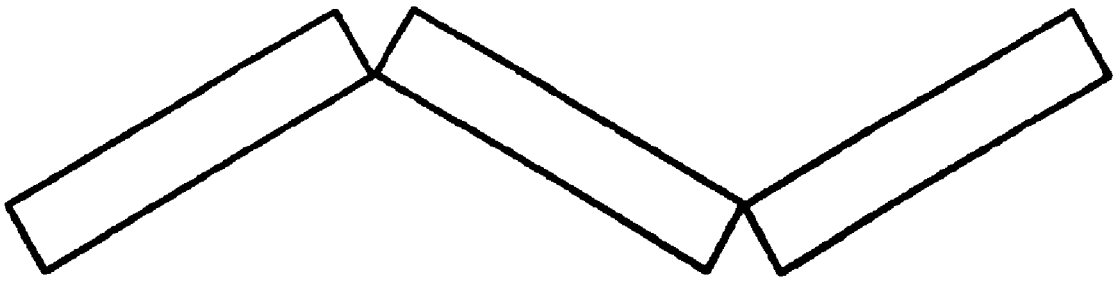
FIG. 2A illustrates a folding beam for a deployment beam in accordance with yet another embodiment of the invention.

FIG. 2A illustrates an embodiment of a deployment beam 200. The deployment beam 200 may be used for the inner and/or outer deployment beam. As shown in FIG. 2A, an inner and/or outer deployment beam may be implemented using a folding beam 200 to provide the expansion and contraction capabilities of the deployment beam.

Figure 2B:
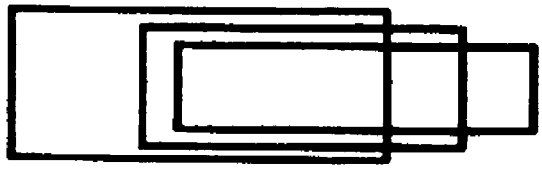
FIG. 2B illustrates a telescoping beam for a deployment beam in accordance with yet another embodiment of the invention.

FIG. 2B illustrates another embodiment of a deployment beam 200'. As shown in FIG. 2B, an inner and/or outer deployment may be implemented using a telescoping beam 200' to provide the expansion and contraction capabilities of the deployment beam.

Although not explicitly shown in the FIGS. 1A–E, the inner and outer deployment beams, 120 and 115, respectively, may be a combination of folding and telescoping beams, 200, and 200', respectively. The deployment beams, 200 and 200', may be constructed from a variety of materials, e.g., aluminum, invar, graphite epoxy, plastic, composites, silicon carbide, shape memory materials, etc. The deployment beams, 200 and 200', may also be implemented in a variety of designs such as box, truss, I-beam, isogrid, inflatable rigidizable, shape memory designs, etc.

Figure 3A:
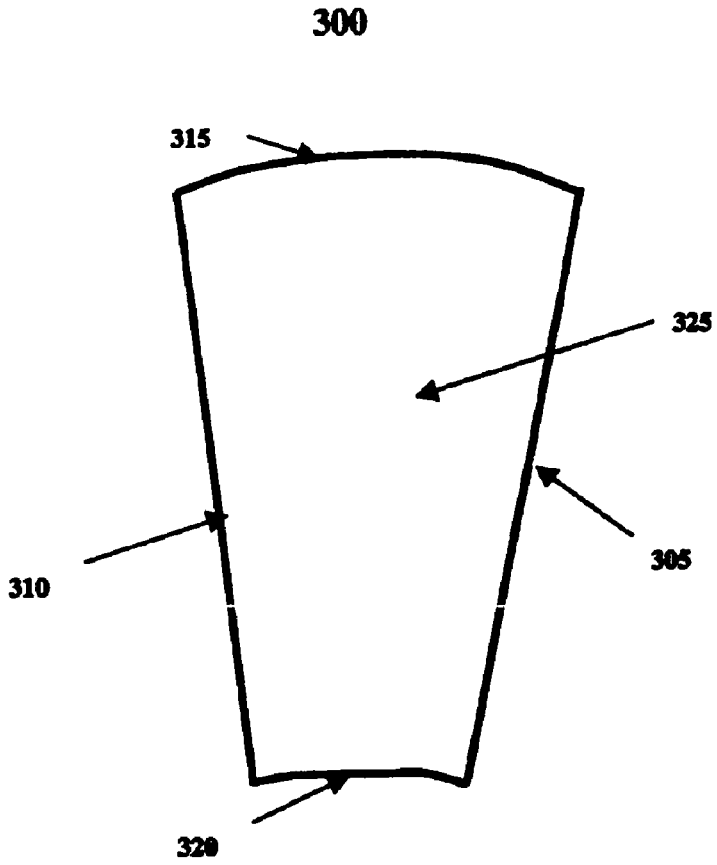
FIG. 3A illustrates a segment of the antenna shown in FIG. 1A in accordance with yet another embodiment of the invention.
Figure 3B:
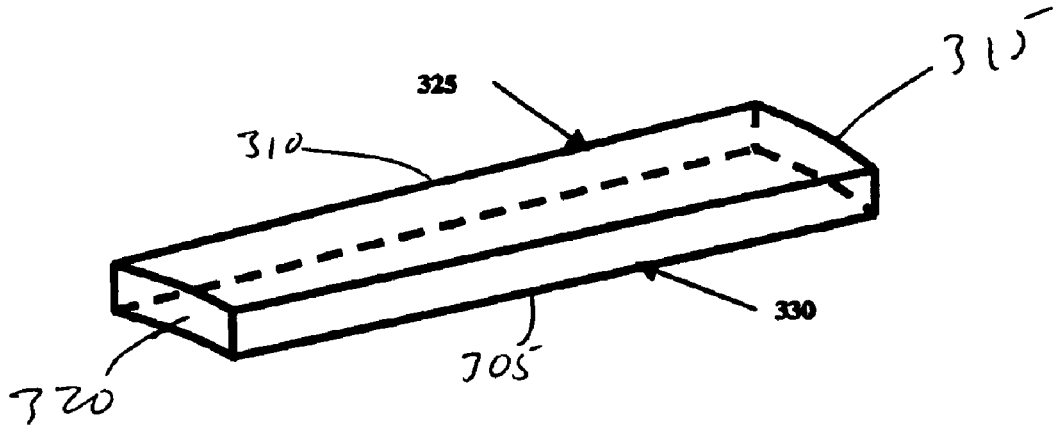
FIG. 3B illustrates a side elevation view of the segment shown in FIG. 3A in accordance with yet another embodiment of the invention.

For descriptive and illustrative purposes, the following terminology is used, referring to FIGS. 3A–B. The "longitudinal side" refers to the side on which adjacent segments are hinged together (310, 305), and it is usually (not necessarily) the longer dimension of the segment. The "inner side" refers to the side (320) that forms the inner edge of the dish reflector when deployed. The "outer side" refers to the side (315) that forms the outer edge of the dish reflector when deployed. In the stowed position, the segments are generally in a vertical position, with the "inner side" at the bottom, so that the "inner side" is same as the "bottom side". Also, in the stowed position the "outer side" is at the top, so that the "outer side" is same as the "top side". Also, the side on which the electromagnetic radiation (RF or optical) is incident (325) is the "front side" of the segment, and the opposite side (330) is the "back side".

FIG. 3A illustrates a plan view of a segment 300 of an antenna in accordance with an embodiment of the invention. FIG. 3B illustrates a side elevational view of the segment 300 shown in FIG. 3A. As shown in FIG. 3A, the segment 300 has a first longitudinal side 305 and a second longitudinal side 310. The segment 300 also has an outer edge (or upper arc) 315 and an inner edge (or lower arc) 320. The reflective surface 325 forms the collection surface for electromagnetic energy. The non-reflective surface 330 is the support surface form the reflective surface 325. Although FIGS. 3A–B illustrates the outer and inner edges, 315 and 320, respectively, as arcs, the outer and inner edges may be a substantially straight line and be within the scope and spirit of the present invention. Moreover, the radius of the outer and inner edges, 315 and 320, respectively, may vary as a function of the number of segments in the antenna, the size of the antenna, weight, and other similar factors.

In various embodiments, the segment 300 may be constructed from materials such as glass, silicon carbide, nanolaminates, copper, aluminum, beryllium, composites, plastics, membranes, and with or without coatings. In various other embodiments, the design of segment 300 may be implemented as a solid, foam, ribbed, actuated, non-actuated, thermally controlled, open back, closed back, and other like designs. In various other embodiments, the design of segment 300 may contain actuators embedded therein to change the shape of the segment when a shape change capability is desirable.

In yet other embodiments, hinge means (not shown) are attached to the longitudinal sides 305, 310. The hinge means provide a mechanism to fold the segments of an antenna in the accordion-like configuration shown with respect to FIGS. 1A–C. In accordance with embodiments, one longitudinal side (305 or 310) has hinge means attached to the one side, where the pivot of the hinge means face the same direction (either top or bottom). The other longitudinal side (310 or 305) has the pivot of the hinge means face the opposite direction (either bottom or top). The number of hinges may vary as a function of the dimension of the segment 300, i.e., height, weight, etc. In certain embodiments, two hinge means are utilized to join two segments at their respective longitudinal sides. Locating hinges in the middle positions exposes the hinges above the front surface of the segment and may induce undesirable scattering. Accordingly, the hinges are attached at or near the corners to reduce the effect of the scattering of incident radiation. However, if the scattering is within performance requirements of an application, the hinges on the front side may also be located in the middle region of the longitudinal side of the segment. Hinges attached to the back (no-reflecting) side of the segment may be at any location along the longitudinal side of the segment because the back of the segment is generally coplanar and there is no scattering issue.

Returning to FIGS. 1A and 1E, the antenna 100 also includes a secondary reflector 180. The secondary reflector 180 may be configured to focus the reflected electromagnetic energy collected by the antenna 100. In other embodiments, the secondary mirror 180 may be replaced by a feed horn. Reflector deployment beams 185 support the secondary reflector 180. More specifically, a first end of a reflector deployment beam 185 is attached to the secondary reflector 180 via a hinge means. A second end of the secondary reflector deployment beam is attached to one of the outer corners a segment via a hinge means. The hinges means may be a hinge, an eyelet or other similar fastening means. The hinge means may be implemented by materials such as aluminum, invar, graphite epoxy, plastic, composites, silicon carbides, shape memory materials, rigidizable materials or other similar materials.

The secondary reflector 180 is shown in the stowed position in FIG. 1A, with reflector deployment beams 185 folded into the central annulus hole formed by the segments 110 in the stowed position. The number of folds for the reflector deployment beams 185 may depend on the height requirements of the secondary reflector 180, the size of the secondary reflector 180, and other similar factors. The reflector deployment beams 185 extend simultaneously with the inner and outer deployment beams, 115 and 120, respectively. The number of mirror deployment beams may vary depending on the size and geometry of the antenna.

With reference to FIG. 1E, the reflector deployment beams 185 are in their respective extended position. When the reflector deployment beams 185 have been fully extended, the secondary reflector 180 is in the deployed position. As shown in FIG. 1E, the reflector deployment beams 185 are in a three-point mount bi-pod configuration. The three-point bi-pod beams (six in total) shown are only one example. Other secondary mirror support methods can also be implemented, such as a tower rising from the center of the base, attached to the base at one end and attached to the secondary reflector or feed horn at the other end. In these embodiments, the tower may be of tubular construction, or folded beam construction.

While the invention has been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Those skilled in the art will recognize that these and other variations are possible within the spirit and scope as defined in the following claims and their equivalents.

What is claimed is:

1. An apparatus for deploying an antenna comprising:

a plurality of segments, each segment hinged to an adjacent segment on a longitudinal side;

a base;

a plurality of inner deployment beams, each inner deployment beam connecting an inner side of a respective segment to the base and each inner deployment beam having a folded position and an extended position; and a plurality of outer deployment beams, each outer deployment beam connecting an outer side of a respective segment to the base and each outer deployment having a folded position and an extended position, wherein said plurality of segments are in a hinged folded position in response to said plurality of inner deployment beams being in the folded position and said outer deployment beams being in the folded position.

2. The apparatus according to claim 1, wherein said plurality of segments are fully extended in response to said plurality of inner and outer deployment beams being in the extended positions.

3. The apparatus according to claim 1, wherein said inner and outer deployment beams comprise of folding beams.

4. The apparatus according to claim 1, wherein said inner and outer deployment beams comprise of telescoping beams.

5. The apparatus according to claim 1, wherein said base has a shape of one of annular, cylindrical, conical or rectangular.

6. The apparatus according to claim 1, wherein the base is adapted to house electronic, optical or other equipment.

7. The apparatus according to claim 1, wherein each segment is rigid.

8. The apparatus according to claim 1, wherein each segment is flexible.

9. The apparatus according to claim 1, further comprising:

a secondary reflector; and a plurality of reflector deployment beams, each beam having an extended position and a folded position, wherein a first end of each deployment beam connected to the secondary reflector and a second end of each deployment beam connected to a position on an outside edge of a respective segment.

10. The apparatus according to claim 1, wherein each segment is attached to an adjacent segment on the longitudinal side by more than one hinge.

11. The apparatus according to claim 1, wherein a first subset of the plurality of segments is rigid and a second subset of the plurality segments is flexible.

12. The apparatus according to claim 1, wherein each outer deployment beam is constructed from one of aluminum, invar, graphite epoxy, plastic, composites silicon carbide, shape memory materials, and rigidizable materials.

13. The apparatus according to claim 1, wherein each inner deployment beam is constructed from one of aluminum, invar, graphite epoxy, plastic, composites silicon carbide, shape memory materials, and rigidizable materials.

14. The apparatus according to claim 1, wherein each segment of the plurality of segments is constructed from one of glass, silicon carbide, nanolaminates, copper, aluminum, beryllium, composites, plastics, and membrane materials.

15. The apparatus according to claim 1, wherein each segment further comprise of shape control actuators embedded within the segment.

16. A method for deploying an antenna, said method comprising:

extending a plurality of inner and outer deployment beams in a folded position, said inner and outer deployment beams attached to a base of the antenna and to an inner and outer edges, respectively, of a plurality of segments, each segment hinged to an adjacent segment on a longitudinal side; and forming a deployed position for the antenna in response to said inner and outer deployment beams reaching a deployed position and said plurality of segments being in an extended state.

17. An apparatus for deploying an antenna comprising:

a plurality of segments, each segment hinged to two other segments on a respective longitudinal side;

a base;

a plurality of inner deployment beams, each inner deployment beam connecting an inner side of a respective mirror segment to the base and each inner deployment beam having a folded position and an extended position; and a plurality of outer deployment beams, each outer deployment beam connecting an outside side of a respective mirror segment to the base and each outer deployment having a folded position and an extended position, wherein said plurality of mirrors are in substantially coplanar position in response to said plurality of inner deployment beams being in an extended position and said outer deployment beams being in the extended position.

18. The apparatus according to claim 17, wherein said plurality of mirrors are in a hinged folded position in response to said plurality of inner and outer deployment beams being in their respective folded positions.

19. The apparatus according to claim 17, wherein said inner and outer deployment beams comprise of folding beams.

20. The apparatus according to claim 17, wherein said inner and outer deployment beams comprise of telescoping beams.

21. The apparatus according to claim 17, wherein said inner and outer deployment means comprise a combination of folding and telescoping beams.

22. The apparatus according to claim 17, further comprising:

a base ring connected to said base and wherein each inner deployment beam of said plurality of inner deployment beams is attached.

23. The apparatus according to claim 22, wherein said base ring is collapsible.

24. The apparatus according to claim 22, wherein said base ring has a shape of one of annular, cylindrical, conical or rectangular.

25. The apparatus according to claim 22, wherein the base ring is adapted to house electronic equipment.

26. The apparatus according to claim 17, wherein the segment is constructed from a rigid material.

27. The apparatus according to claim 17, wherein the segment is constructed from a flexible material.

28. The apparatus according to claim 17, wherein the plurality of segments form an accordion-like formation in response to being folded.

29. The apparatus according to claim 17, wherein for each segment, one set of hinge means are attached in a first direction on one longitudinal side and a second set of hinge means are attached in a second direction on the second longitudinal side.

* * * * *